US009803652B2

(12) United States Patent
Duong et al.

(10) Patent No.: US 9,803,652 B2
(45) Date of Patent: Oct. 31, 2017

(54) CENTRIFUGAL COMPRESSOR DIFFUSER AND METHOD FOR CONTROLLING SAME

(71) Applicant: Pratt & Whitney Canada Corp., Longueuil (CA)

(72) Inventors: Hien Duong, Mississauga (CA); Peter Townsend, Mississauga (CA); Vijay Kandasamy, Tamil Nadu (IN); Koundinya Upadrasta, Andhra Pradesh (IN)

(73) Assignee: PRATT & WHITNEY CANADA CORP., Longueuil (CA)

( * ) Notice: Subject to any disclaimer, the term of this patent is extended or adjusted under 35 U.S.C. 154(b) by 890 days.

(21) Appl. No.: 14/176,253

(22) Filed: Feb. 10, 2014

(65) Prior Publication Data

US 2015/0226232 A1 Aug. 13, 2015

(51) Int. Cl.

| | |
|---|---|
| ***F01D 9/06*** | (2006.01) |
| ***F04D 29/44*** | (2006.01) |
| ***F04D 29/68*** | (2006.01) |
| ***F04D 27/02*** | (2006.01) |
| ***F04D 17/10*** | (2006.01) |

(52) U.S. Cl.

CPC ..... *F04D 29/441* (2013.01); *F04D 17/10* (2013.01); *F04D 27/0207* (2013.01); *F04D 29/681* (2013.01); *F04D 29/684* (2013.01)

(58) Field of Classification Search

CPC ..... F04D 29/444; F04D 29/684; F04D 29/441
See application file for complete search history.

(56) References Cited

U.S. PATENT DOCUMENTS

| | | | | |
|---|---|---|---|---|
| 3,768,919 | A * | 10/1973 | O'Connor | F04D 29/441 415/116 |
| 3,856,430 | A | 12/1974 | Langham | |
| 4,131,389 | A | 12/1978 | Perrone et al. | |
| 4,368,005 | A | 1/1983 | Exley et al. | |

(Continued)

FOREIGN PATENT DOCUMENTS

| | | |
|---|---|---|
| EP | 1507977 | 2/2005 |
| JP | S569696 | 1/1981 |

(Continued)

*Primary Examiner* — Craig Kim
*Assistant Examiner* — Jason Fountain
(74) *Attorney, Agent, or Firm* — Norton Rose Fulbright Canada LLP

(57) ABSTRACT

A centrifugal compressor having at least a diffuser is disclosed. The diffuser has an annular diffuser body having circumferentially spaced apart diffuser passages defining fluid paths through the diffuser body. The diffuser also has a plurality of diffusion members mounted to the annular diffuser body. Each diffusion member has a member inlet in fluid communication with a diffuser passage and a member outlet. Each diffusion member defines an aerodynamic throat disposed between the member inlet and the member outlet. The diffuser also has a fluid injection assembly with multiple injection conduits. Each injection conduit extends between a conduit inlet configured to receive a flow of compressible fluid from a supply and a conduit outlet communicating with a corresponding diffusion member downstream of the aerodynamic throat. The compressible fluid is injected through the conduit outlet into the diffusion members.

20 Claims, 10 Drawing Sheets

(56) References Cited

U.S. PATENT DOCUMENTS

| | | | | |
|---|---|---|---|---|
| 6,589,015 | B1 * | 7/2003 | Roberts | F01D 9/045 415/208.3 |
| 6,699,008 | B2 | 3/2004 | Japikse | |
| 7,326,027 | B1 * | 2/2008 | Skoch | F04D 27/0207 415/150 |
| 7,553,122 | B2 | 6/2009 | Kirtley | |
| 8,021,104 | B2 | 9/2011 | Gu et al. | |
| 8,122,724 | B2 | 2/2012 | Slovisky et al. | |
| 8,287,232 | B2 | 10/2012 | Gu et al. | |
| 8,641,373 | B2 | 2/2014 | Porodo et al. | |
| 2013/0036760 | A1 * | 2/2013 | Sun | F01D 5/145 62/467 |
| 2015/0226232 | A1 | 8/2015 | Duong et al. | |

FOREIGN PATENT DOCUMENTS

| | | |
|---|---|---|
| WO | 2012060825 | 5/2012 |
| WO | 2012166858 | 12/2012 |
| WO | 2013084525 | 6/2013 |

* cited by examiner

CENTRIFUGAL COMPRESSOR DIFFUSER AND METHOD FOR CONTROLLING SAME

TECHNICAL FIELD

The application relates generally to gas turbine engines and, more particularly, to diffusers for centrifugal compressors.

BACKGROUND

Stable operation of centrifugal compressors in gas turbine engines is limited by two forms of instabilities: rotating stall and surge. Both stall and surge can be detrimental not only to the performance of the compressor and its operability, but to its structural integrity as well. The diffuser of the compressor, and particularly the diffuser pipes, can contribute to these instabilities. Conventional passage control techniques for improving the stall range in diffuser pipes involve changing the throat size of the diffuser pipes, or performing overboard bleed. However, these solutions can require expensive hardware upgrades, modifications, or engine rematching.

SUMMARY

In one aspect, there is provided an assembly having a diffuser for diffusing gases radially received from a radial outlet of a centrifugal compressor including an impeller having an inner hub with vanes thereon, the impeller adapted to rotate within an outer shroud about a central longitudinal axis, the assembly comprising: an annular diffuser body having a plurality of circumferentially spaced apart diffuser passages at least partially defining fluid paths through the diffuser body, the diffuser passages each having a passage inlet in fluid communication with the outlet of the compressor, and a passage outlet; a plurality of diffusion members mounted to the annular diffuser body, each diffusion members having a member inlet in fluid communication with the passage outlet of a corresponding diffuser passage and a member outlet, each diffusion member defining an aerodynamic throat disposed between the member inlet and the member outlet; and a fluid injection assembly having a plurality of injection conduits, each injection conduit extending between a conduit inlet configured to receive a flow of compressible fluid from a supply and a conduit outlet communicating with a corresponding diffusion member downstream of the aerodynamic throat relative to a direction of a main gas flow through said diffusion member.

In another aspect, there is provided method for controlling a centrifugal compressor, the centrifugal compressor including an impeller which feeds a main gas flow into a diffuser downstream therefrom, the method comprising: directing the main gas flow through a plurality of diffusion members of the diffuser between an inlet and an outlet thereof; and injecting a compressible fluid into the main gas flow in the diffusion members at a location downstream of an aerodynamic throat of each of the diffusion members.

In a further aspect, there is provided a centrifugal compressor, comprising: an impeller having an inner hub with vanes thereon and adapted to rotate within an outer shroud about a central longitudinal axis, the impeller having a radial impeller outlet; and a diffuser assembly for diffusing gases radially received from the impeller outlet, comprising: an annular diffuser body having a plurality of circumferentially spaced apart diffuser passages at least partially defining fluid paths through the diffuser body, the diffuser passages each having a passage inlet in fluid communication with the impeller outlet and a passage outlet; a plurality of diffusion members mounted to the annular diffuser body, each diffusion member having a member inlet in fluid communication with the passage outlet of a corresponding diffuser passage and a member outlet, each diffusion member defining an aerodynamic throat disposed between the member inlet and the member outlet; and a fluid injection assembly having a plurality of injection conduits, each injection conduit extending between a conduit inlet configured to receive a flow of compressible fluid from a supply and a conduit outlet communicating with a corresponding diffusion member downstream of the aerodynamic throat relative to a direction of a main gas flow through said diffusion member.

DESCRIPTION OF THE DRAWINGS

Reference is now made to the accompanying figures in which.

DETAILED DESCRIPTION

Figure 1:
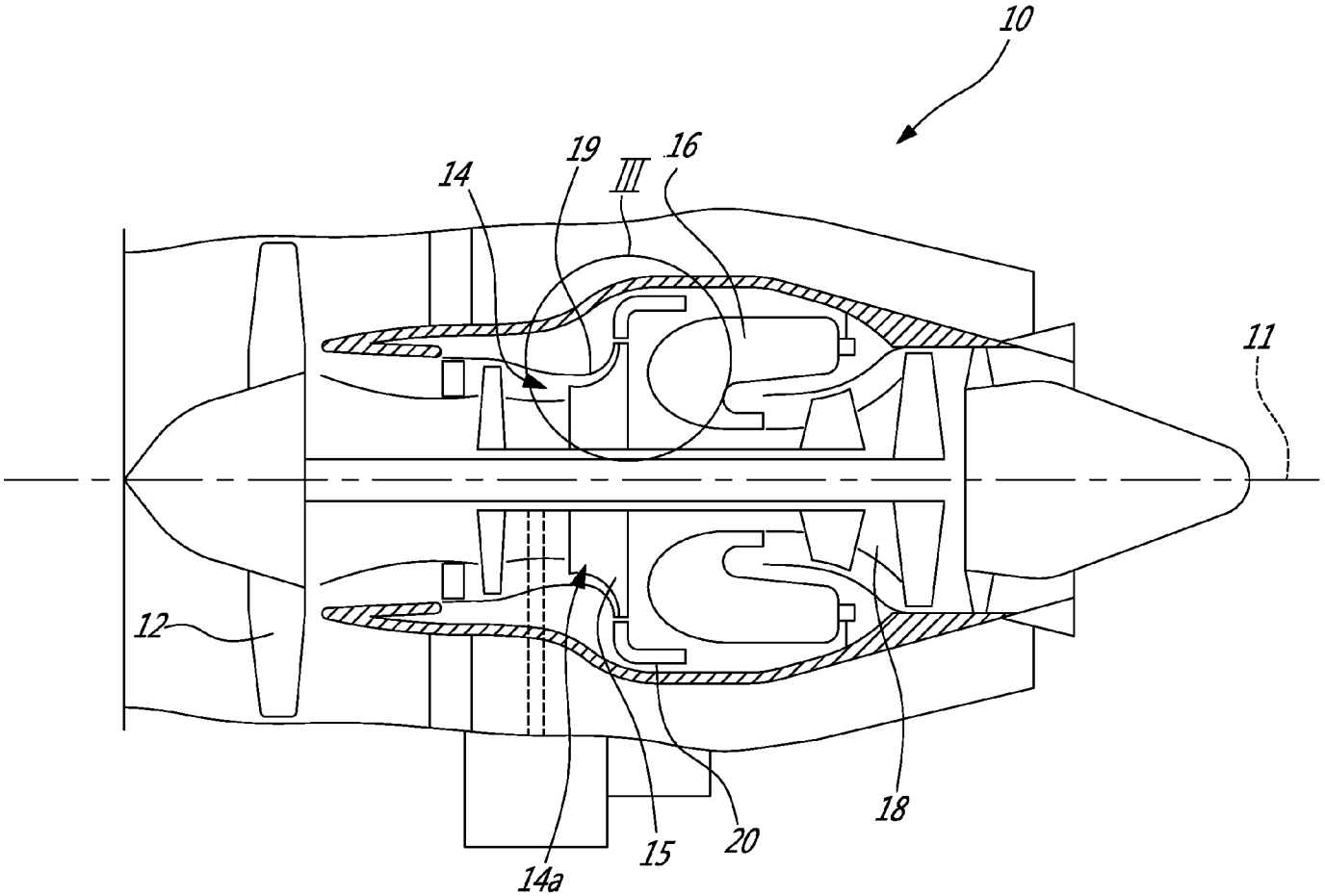
FIG. 1 is a schematic cross-sectional view of a gas turbine engine.

FIG. 1 illustrates a gas turbine engine 10 of a type preferably provided for use in subsonic flight, generally comprising in serial flow communication a fan 12 through which ambient air is propelled, a compressor section 14 for pressurizing the air, a combustor 16 in which the compressed air is mixed with fuel and ignited for generating an annular stream of hot combustion gases, and a turbine section 18 for extracting energy from the combustion gases. Also shown is a central longitudinal axis 11 of the engine 10.

Figure 2:
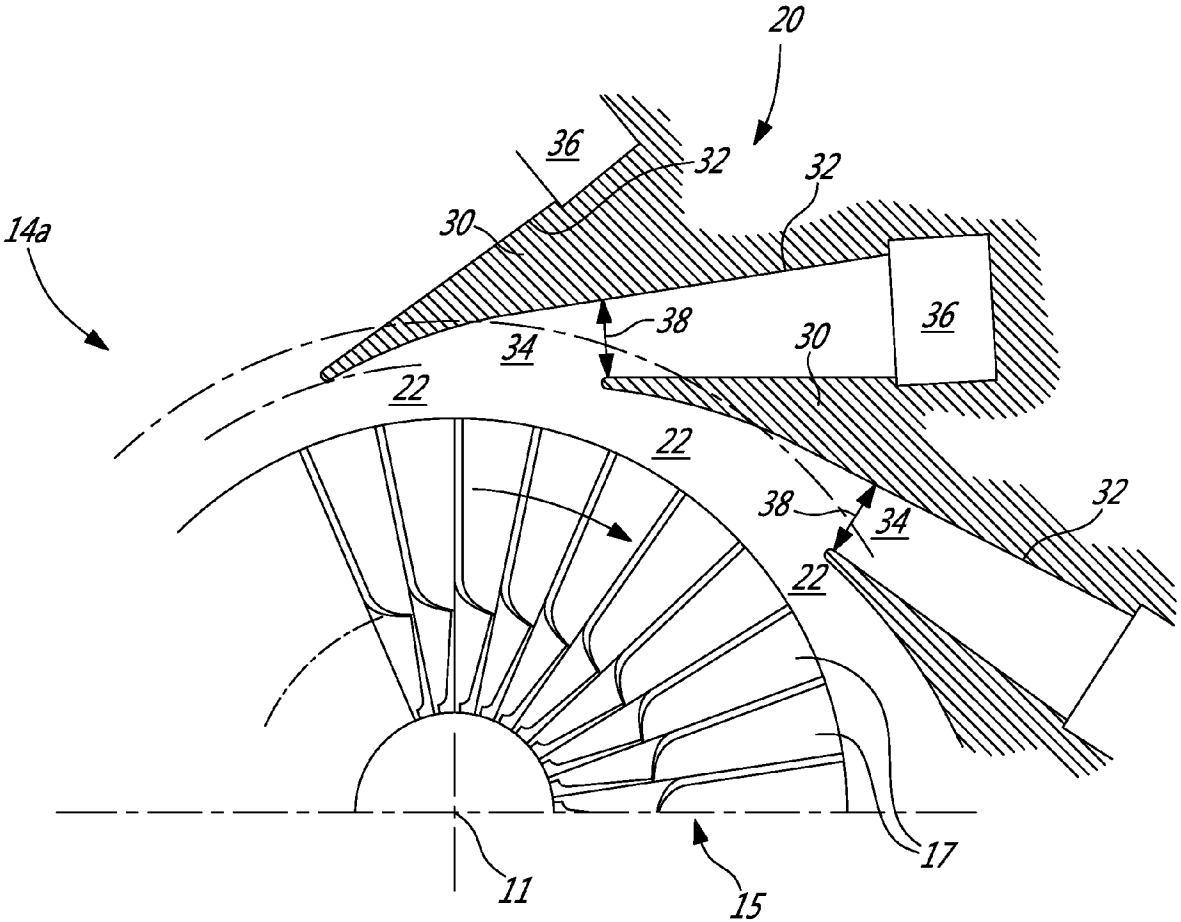
FIG. 2 is a partial transverse cross-sectional view of a portion of a centrifugal compressor of the gas turbine engine of FIG. 1, viewed along the direction of a longitudinal central axis of the gas turbine engine.

Of particular interest in the present disclosure is the compressor section 14. Referring to FIGS. 1 and 2, the compressor section 14 of the engine 10 includes one or more compressor stages, at least one of which includes a centrifugal compressor 14*a*. The centrifugal compressor 14*a* includes a rotating impeller 15 with impeller vanes 17 and a downstream diffuser assembly 20. The impeller 15 is configured to rotate within an outer shroud 19 about the central axis 11. The impeller 15 draws air axially, and rotation of the impeller 15 increases the velocity of a main gas flow as the main gas flow is directed though the impeller vanes 17, to flow out in a radially outward direction under centrifugal forces.

The diffuser assembly 20 (or simply "diffuser 20") is positioned immediately downstream of the exit of the impeller 15. The diffuser 20 forms the fluid connection between the impeller 15 and the combustor 16, thereby allowing the impeller 15 to be in serial flow communication with the combustor 16. The diffuser 20 redirects the radial flow of the main gas flow exiting the impeller 15 to an annular axial flow for presentation to the combustor 16. The diffuser 20 also reduces the velocity and increases the static pressure of the main gas flow when it is directed therethrough. The diffuser 20 includes an annular diffuser body 30 mounted about the impeller 15, multiple diffusion members 40 in fluid communication with the diffuser body 30, and a fluid injection assembly 50 for injecting a compressible fluid (e.g. air) into the diffusion members 40.

Referring to FIG. 2 in more detail, the annular diffuser body 30 forms the corpus of the diffuser 20 and provides the structural support required to resist the loads generated during operation of the compressor 14*a*. In most embodiments, the diffuser body 30 is a diffuser ring which can have a vaned, vane-less, or semi-vaned space. The diffuser body 30 is mounted about a circumference of the compressor or impeller outlet 22 so as to receive the main gas flow therefrom.

The diffuser body 30 has one or more diffuser passages 32. The diffuser passages 32 can be fluid conduits or machined orifices which extend through some, or all, of the diffuser body 30, thus defining fluid paths along which the main gas flow can be conveyed. The diffuser passages 32 each have a passage inlet 34 which is in fluid communication with the impeller outlet 22 so as to receive the main gas flow therefrom, as well as a passage outlet 36 through which the main gas flow exits when it leaves each diffuser passage 32.

Figure 7:
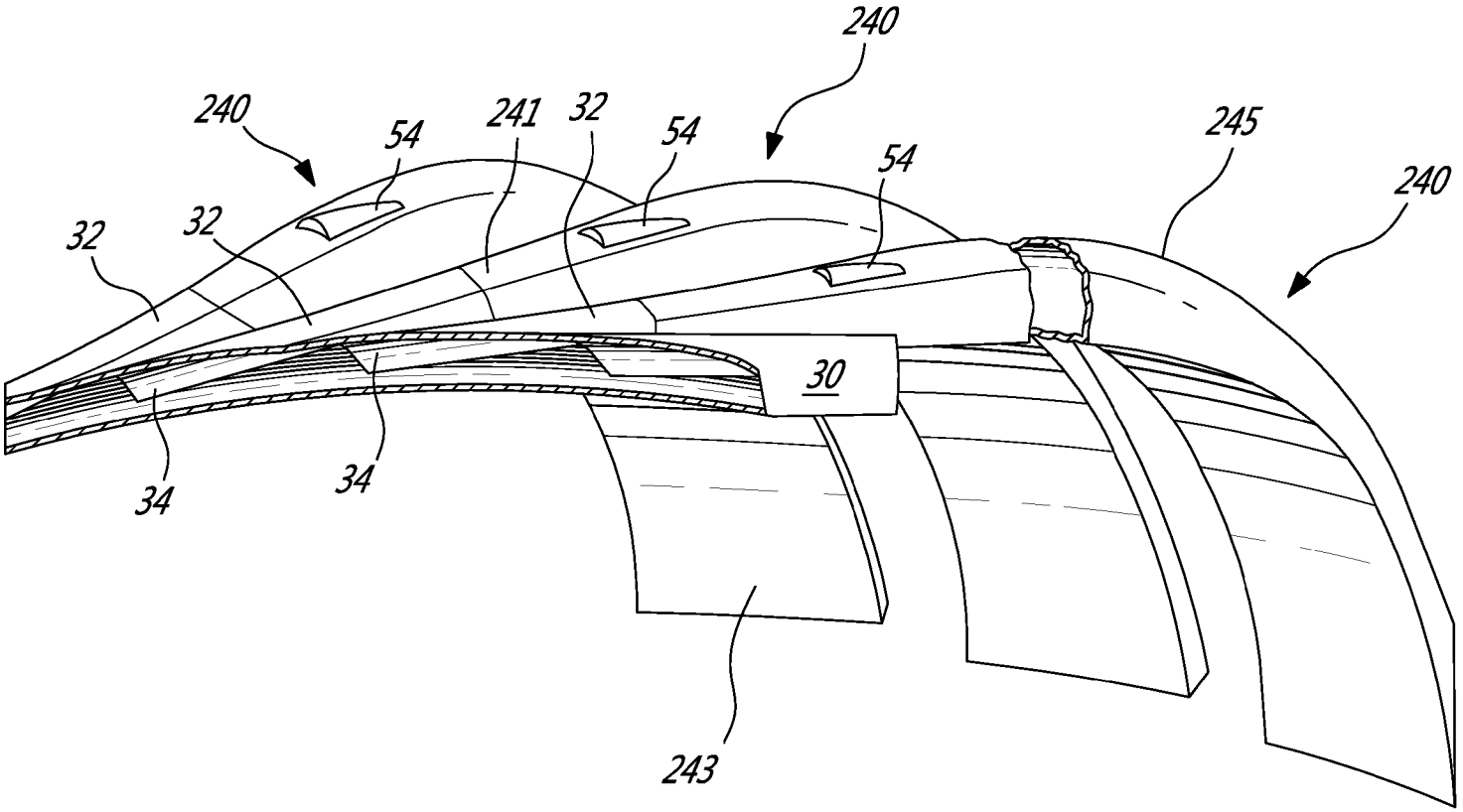
FIG. 7 is a perspective view of a plurality of diffusion members of a diffuser, according to an alternate embodiment.

The diffuser passages 32 are spaced about the circumference of the diffuser body 30, and extend substantially tangentially through the diffuser body 30, as shown in FIG. 7. The geometry of the diffuser passages 32 can vary. One possible configuration for the diffuser passages 32 is described in U.S. Pat. No. 7,156,618 B2 to Fish et al., the entirety of which is hereby incorporated by reference. Irrespective of the chosen configuration of the diffuser passages 32, it can be appreciated that the annular diffuser body 30 is positioned to surround a periphery of the impeller 15 for capturing the pressurized main gas flow and directing it radially and outwardly through the diffuser passages 32.

Returning to FIG. 2, each diffuser passage 32 defines a passage throat 38. The passage throat 38 may be located at the passage inlet 34. The precise location of the passage throat 38 within the diffuser passage 32 can be determined using the measured flow characteristics of the main gas flow within the diffuser passage 32, or can correspond to the part of the diffuser passage 32 having the smallest cross-sectional area. From the relatively small cross-sectional area of the passage throat 38, each diffuser passage 32 can expand in cross-sectional area along its length from the passage inlet 34 to the passage outlet 36, thereby helping to diffuse the main gas flow as it is conveyed through the diffuser passages 32.

As previously mentioned, the diffuser 20 also includes one or more diffusion members 40 disposed downstream from the diffuser body 30. The diffusion members 40 can be any device or mechanism which reduces the velocity and increases the static pressure of the main gas flow when it is directed thought and/or along the length of the diffusion members 40. Some examples of such devices and mechanisms include vane diffusers, passage diffusers, vane-less diffusers, and pipe diffusers. In the exemplary embodiments shown in the figures, the diffusion members 40 are diffuser pipes, and the terms "diffusion members 40" and "diffuser pipes 40" may thus used interchangeably here. It will be appreciated that such references to diffuser pipes 40 does not limit the diffusion members 40 to being this particular device or mechanism.

Figure 3:
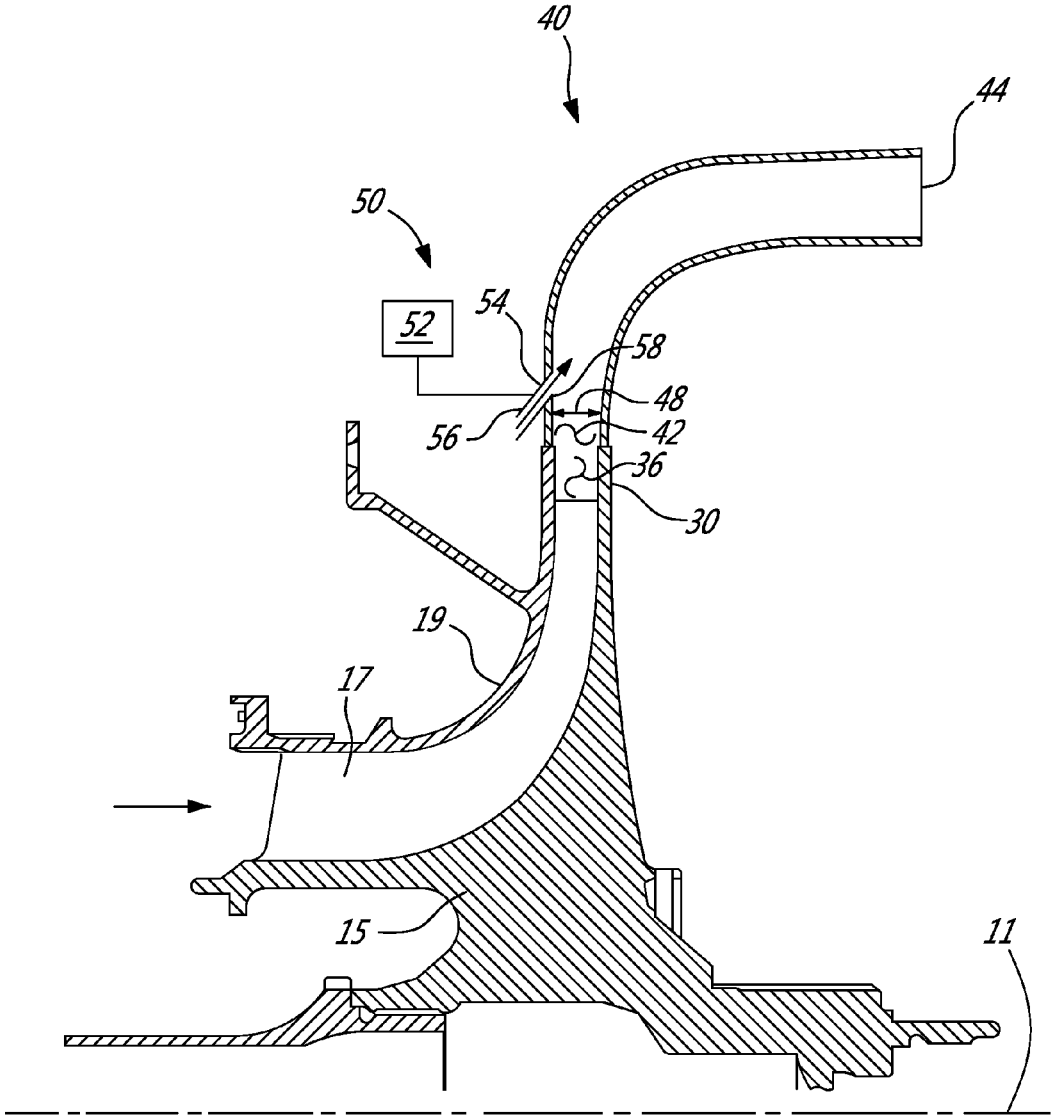
FIG. 3 is an enlarged cross-sectional view of a portion of the centrifugal compressor of FIG. 2, taken from region III in FIG. 1 having an impeller and a downstream diffuser.

Referring to FIG. 3, each of the diffuser pipes 40 is mounted to the diffuser body 30 at a circumferential point thereon corresponding to a diffuser passage 32. Each of the diffuser pipes 40 diffuses the main gas flow, meaning that they slow its velocity and increase its static pressure along their length, and convey it downstream of the compressor 14*a*. Each diffuser pipe 40 has a member or pipe inlet 42 which is in fluid communication with the passage outlet 36 of a corresponding diffuser passage 32, and a member or pipe outlet 44 through which the main gas flow is conveyed out of the diffuser pipe 40 and downstream of the compressor 14*a*. The diffuser pipes 40 can take many different configurations, some of which will now be discussed.

Figure 4:
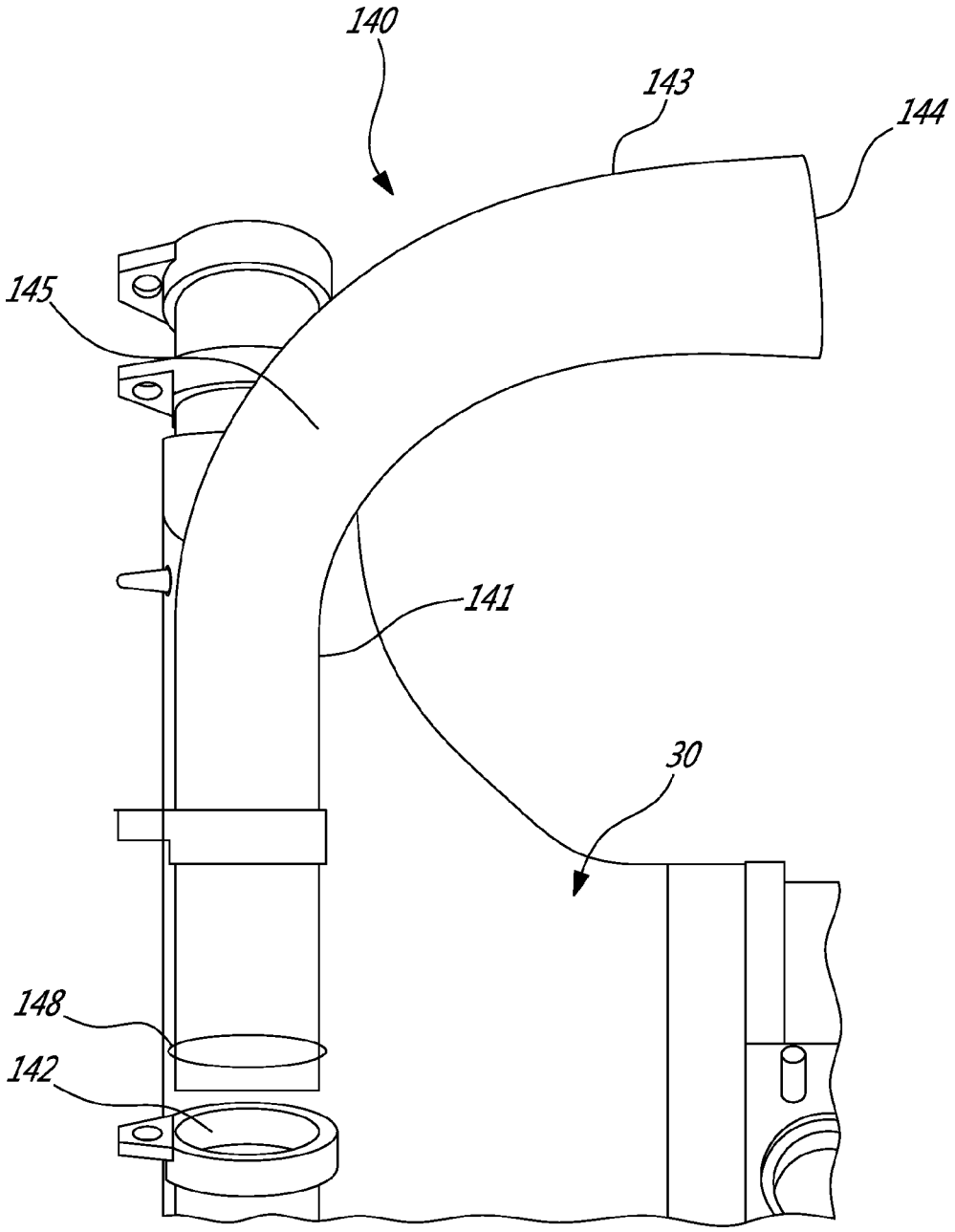
FIG. 4 is a schematic side elevational view of a diffusion member of the diffuser of a centrifugal compressor, such as the one shown in FIG. 3.
Figure 5:
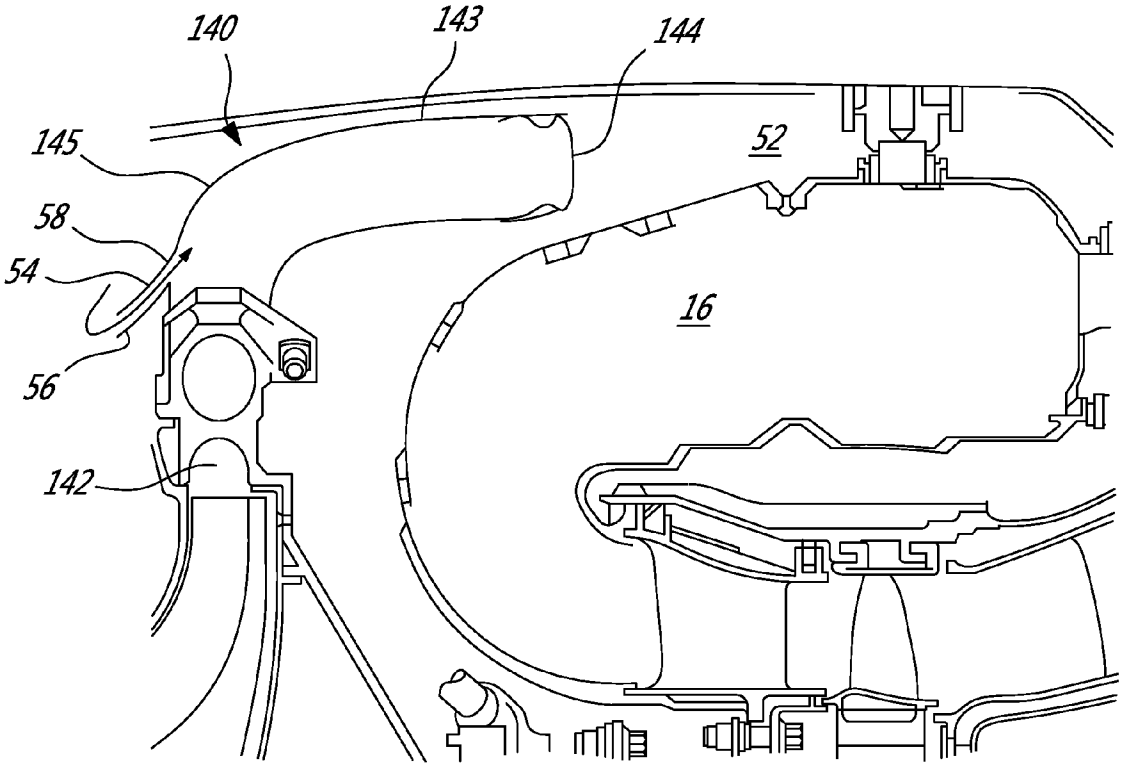
FIG. 5 is a partial cross-sectional view of the diffuser of FIG. 4, being shown in proximity to a combustor of a gas turbine engine such as the one shown in FIG. 1.
Figure 6:
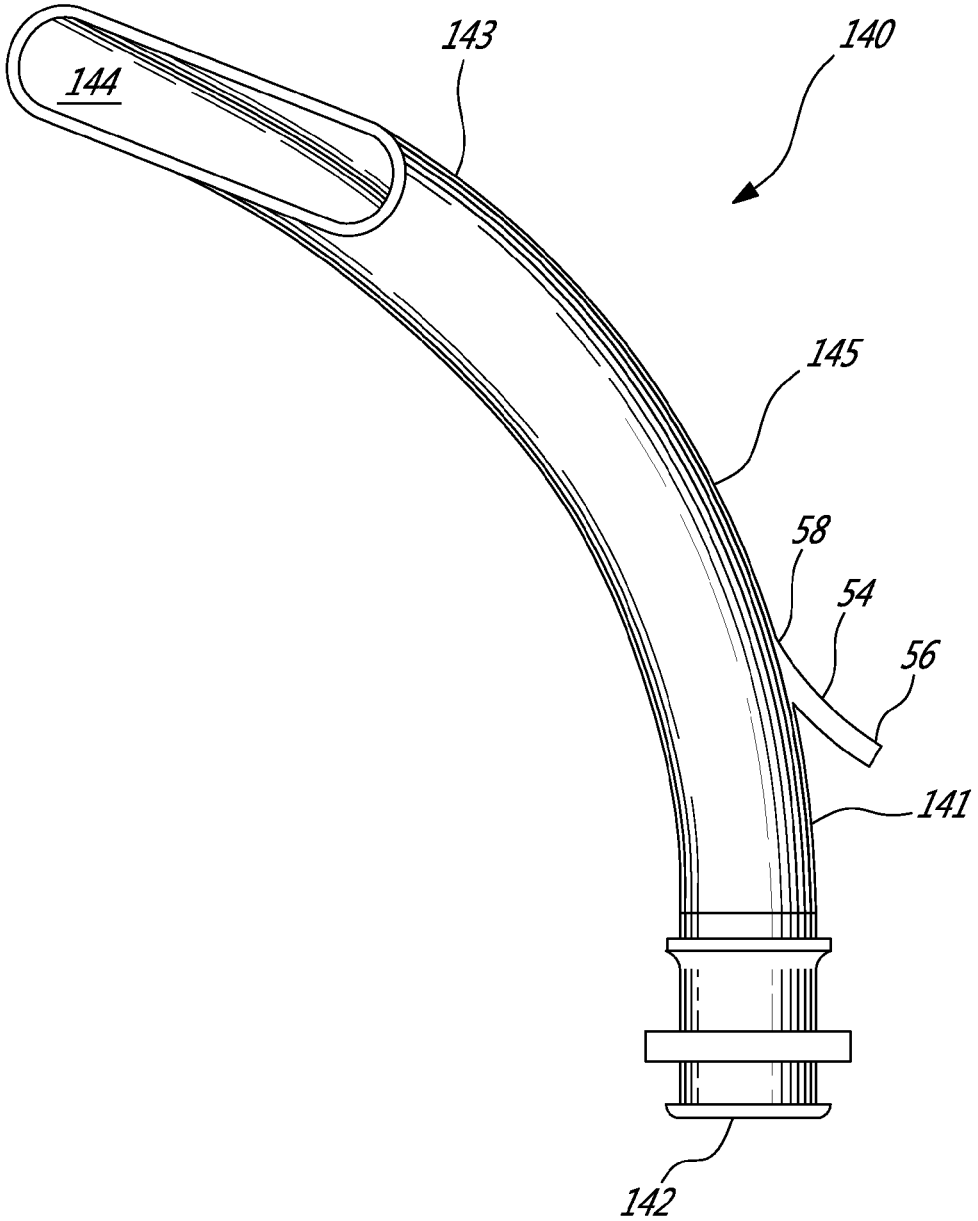
FIG. 6 is a perspective view of the diffusion member of FIG. 4.

One possible configuration for a diffuser pipe 140 is shown in FIGS. 4 to 6. The pipe inlet 142 of the diffuser pipe 140 can be bolted onto the diffuser body 30 using a ferrule or other mechanical fastener, or can be alternatively brazed onto the diffuser body 30. Such a diffuser pipe 140 defines an internal passage having a cross-sectional area expanding from the pipe inlet 142 towards the pipe outlet 144, and is generally referred to as a "fishtail" pipe. The diffuser pipes 140 direct the main gas flow from corresponding passage outlets 36 through the expanding cross-section, thereby discharging the main gas flow to the combustor 16 at a low velocity and high pressure.

Each diffuser pipe 140 defines three sections along its length. A first section 141 extends along a length which begins at the pipe inlet 142 and extends away therefrom. The first section 141 can extend at an orientation that is both tangential and radial to the flow of the main gas flow as it exits the impeller 15. A second section 143 extends in an axial direction and thus substantially parallel to the central axis 11 along its second section length. The second section 143 ends at the pipe outlet 144, and helps to convey the main gas flow downstream of the compressor 14*a*, such as to the combustor 16. A third, intermediate, curved section 145 links the first and second sections 141,143 and is in fluid communication with both of these. The curved section 145 begins at the end of the first section 141 and ends at the beginning of the second section 143. The curved section 145 curves or redirects the main gas flow from a substantially radial orientation in the first section 141 to a substantially axial orientation in the second section 143.

Another possible configuration for the diffuser pipe 240 is shown in FIG. 7. The diffuser pipe 240 shown can also have in serial flow communication a first section 241, a curved section 245, and a second section 243 which are similar to the first section 141, the curved section 145, and the second section 143 of the diffuser pipe 140 described above.

Returning to FIG. 3, each diffuser pipe 40 defines and contains therein an aerodynamic throat 48 located between the pipe inlet 42 and the pipe outlet 44. The location of the aerodynamic throat 48 of the pipe (or simply "pipe throat 48") along the length of the diffuser pipe 40 can vary depending on numerous factors such as the flow conditions of the main gas flow in the diffuser pipe 40, the geometry of the diffuser pipe 40, and the flow conditions upstream and/or downstream of the diffuser pipe 40. For most applications, the location of the pipe throat 48 within the diffuser pipe 40 can be suitably approximated for a given range of operating conditions of the compressor 14*a* using fluid dynamic analysis. Alternatively, the location of the pipe throat 48 can be approximated to correspond to the location of the smallest cross-sectional area of the diffuser pipe 40 in which it is located.

In the embodiments where one or more diffuser pipes 40 has first, curved, and second sections 141,145,143, and as shown in FIG. 4, the throat 148 can be disposed in one of the first and curved sections 141,145. The throat 148 can also be inside the diffuser ring 30 for some flow conditions, and is generally ahead of the location where flow reversal is first experienced. In most instances, this occurs somewhere within the curved section 145.

Returning to FIG. 3, and as previously mentioned, the diffuser 20 includes a fluid injection assembly 50. The fluid injection assembly 50 (or simply the "injection assembly 50") is configured to supply a compressible fluid (e.g. air) to the diffuser pipes 40. It is known that the main gas flow in the diffuser pipes 40 can experience an adverse pressure gradient in the direction of flow. This pressure gradient coupled with existing friction forces in the boundary layer of the wall of the diffuser pipes 40 can strengthen the effect of deceleration experienced by the main gas flow, which may result in the boundary layer being built up within the diffuser pipe. This buildup leads to increased flow blockage, diminishes pressure recovery, and can eventually lead to flow separation.

By injecting the compressible fluid into the diffuser pipes 40 at a suitable location, it may be possible to prevent and/or reduce increased blockage and flow separation by energizing the boundary layer along the walls of the diffuser pipes 40. Flow with momentum deficit at the walls is replaced with high momentum flow, making the main gas flow more resistant to flow separation. Another possible benefit may be that the injected compressible fluid helps to keep the main gas flow attached to the walls. The injection assembly 50 has a supply 52 of the compressible fluid, and one or more injection conduits 54 for injecting the compressible fluid into each of the diffuser pipes 40, both of which will now be discussed.

The injection assembly 50 draws the compressible fluid from the supply 52. The supply 52 can be any source of the compressible fluid which is independent of the diffuser 20 and/or the compressor 14*a*. The compressible fluid from this supply 52 can be actively provided, meaning that it can pumped or otherwise actively directed to the injection conduits 54.

Alternatively, and as shown in FIG. 5, the supply 52 can simply be a region of higher pressure within the compressor 14*a* or downstream thereof. For example, the supply 52 of compressible fluid can be the region downstream of the pipe outlet 44 and and adjacent to an inlet of the combustor 16. This area will generally be filled with so-called "P3" air. Therefore, the compressible fluid injected into the diffuser pipes 40 via the injection conduits 54 can be P3 air. In such a configuration, the P3 compressible fluid can recirculate passively toward the injection conduits 54 because the static pressure at the supply 52 is typically greater than the static pressure at the location of the injection conduits 54. Such a passive circulation system can be more easily implemented in existing diffusers. In most embodiments, the compressible fluid is the same as the fluid of the main gas flow.

Returning to FIG. 3, the injection conduits 54 are in fluid communication with both the supply 52 and a corresponding diffuser pipe 40 so as to inject the compressible fluid into the diffuser pipe 40. Each injection conduit 54 can be a pipe or duct, or can alternatively be a bore, orifice, or slot in the wall of a corresponding diffuser pipe 40. Each injection conduit 54 extends along its length between a conduit inlet 56 which can receive the compressible fluid from the supply 52, and conduit outlet 58.

The conduit outlet 58 of each injection conduit 54 opens into, and is in fluid communication with, a corresponding diffuser pipe 40. The conduit outlet 58 can be an injection slot or hole extending through the wall or the diffuser pipe 40. The conduit outlet 58 opens into the diffuser pipe 40 at a point downstream of the pipe throat 48, so that the injection conduit 54 can inject the compressible fluid into the diffuser pipe 40 at a location downstream of the pipe throat 48. The number of conduit outlets 58 that an injection conduit 54 has may be greater than one, such that the injection conduit 54 can inject the compressible fluid into the diffuser pipe 40 at multiple locations on the diffuser pipe 40. The location of the conduit outlet 58 may be in the first section of the diffuser pipe 40, for example. By locating the conduit outlet 58 in this position, the compressible fluid exiting the injection conduit 54 may energize the boundary layer of the main gas flow in the diffuser pipe 40 so as to reduce or prevent any flow separation. It is believed that such a reduction in flow separation can reduce the mixing losses in the diffuser pipe 40, improve the overall efficiency and range of the compressor 14*a*, and improve the operability of the front stages of the engine 10.

It will be appreciated that the injection conduits 54 can take many different configurations to achieve such functionality, one of which is now described.

Figure 8A:
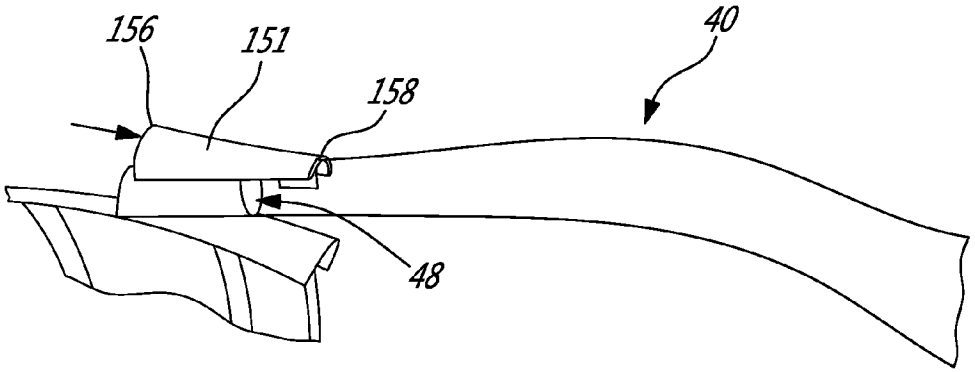
FIG. 8A is a perspective schematic view of an injection conduit of a diffuser, according to another embodiment.
Figure 8C:
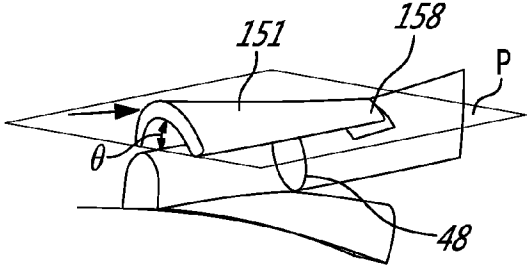
FIG. 8C is yet another perspective schematic view of the injection conduit of FIG. 8A.
Figure 8B:
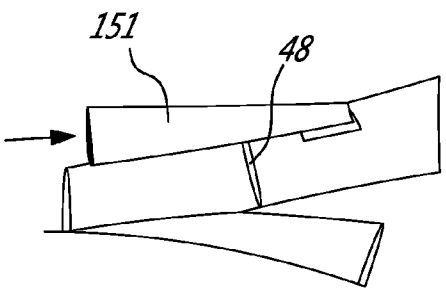
FIG. 8B is another perspective schematic view of the injection conduit of FIG. 8A.

Referring to FIGS. 8A to 8C, one or more of the injection conduits 154 can have a convergent nozzle or duct 151. The convergent duct 151 extends between the conduit inlet 156 and the conduit outlet 158, and can be used to control the velocity at which the compressible fluid is injected into the diffuser pipe 40, the amount of the compressible fluid injected, and/or the angle at which it is introduced. This angle can be referred to as a convergence angle θ, and is best shown in FIG. 8C. The convergence angle θ can be defined between the convergent duct 151 and a plane P that is substantially tangent to the outside surface of the diffuser pipe 40 at the conduit outlet 158. In most embodiments, the convergence angle θ is selected so that the compressible fluid exits the convergent duct 151 at an orientation substantially parallel to the angle of the flow of the main gas flow in the diffuser pipe 40. This can allow the compressible fluid to be injected substantially parallel to the flow of the main gas flow, thus causing minimal disturbances to the main gas flow while still energizing its boundary layer. The value of the convergence angle θ can thus vary based on numerous factors, such as the location of the conduit outlet 158 on the diffuser pipe 40, and the orientation of the main gas flow within the pipe.

FIGS. 9A to 9D are graphs comparing estimates of various compressor 14*a* performance characteristics for a diffuser without the fluid injection assembly (represented by the curve having the rhombus-shaped points) versus a diffuser 20 with the fluid injection assembly 50 (represented by the curve having the triangular points). The curves of these graphs are provided for the sole purpose of comparing the performance characteristics of two different compressors, and are not to understood as being representative of the only possible performance characteristics for these compressors, or any others. Indeed, it will be appreciated that shape of these curves, their values, and their comparative differences can vary if the operating conditions or configurations of the compressors are changed.

Figure 9A:
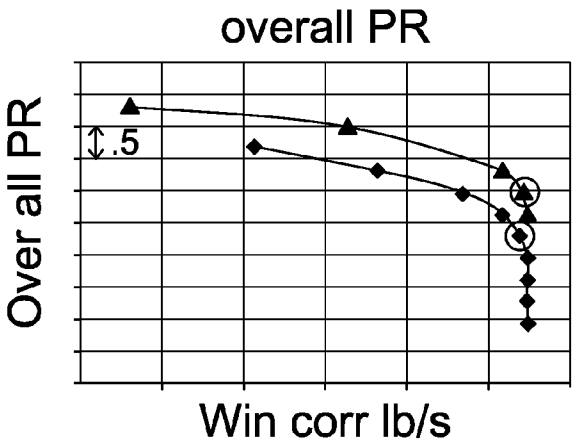
FIG. 9A is a graph comparing the overall pressure ratio for a baseline compressor versus one having a fluid injection assembly.
Figure 9B:
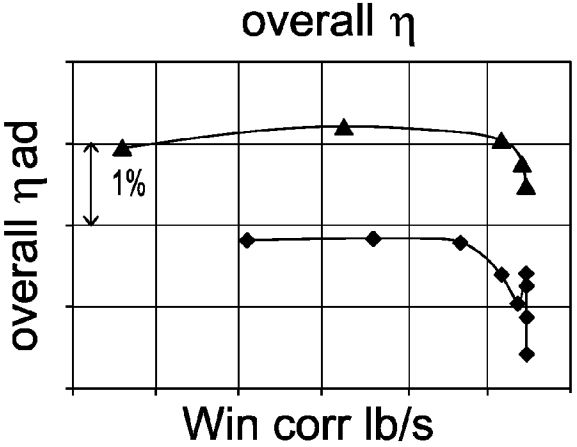
FIG. 9B is a graph comparing the overall efficiency for a baseline compressor versus one having a fluid injection assembly.
Figure 9C:
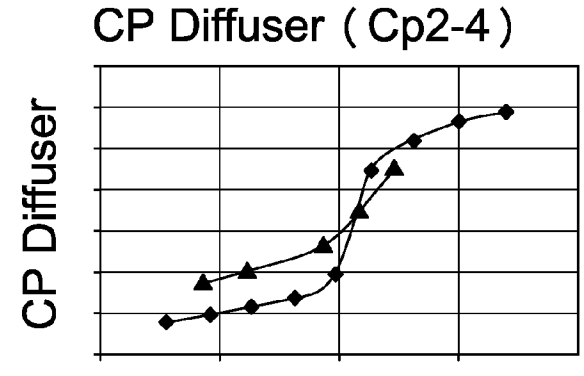
FIG. 9C is a graph comparing the diffuser pipe performance/operability for a baseline compressor versus one having a fluid injection assembly.
Figure 9D:
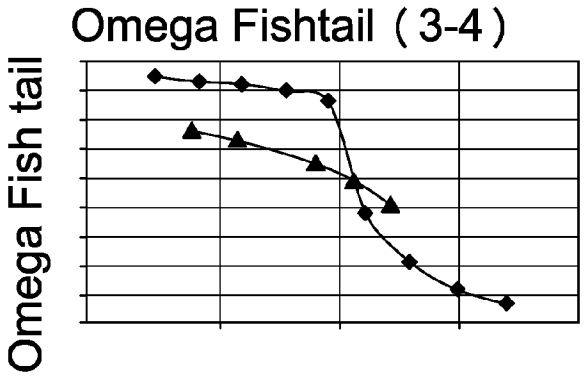
FIG. 9D is a graph comparing the quality of exit flow from the diffuser pipes for a baseline compressor versus one having a fluid injection assembly.

FIGS. 9A and 9B show significant improvements in a compressor 14*a* having the diffuser 20 with the fluid injection assembly 50, as measured by compressor overall pressure ratio (PR) and efficiency, respectively, for various mass flow rates. FIGS. 9C and 9D show significant improvements in a compressor 14*a* having the diffuser 20 with the fluid injection assembly 50, as measured by diffuser performance and the quality of exit flow from the diffuser pipe 40, respectively, for various mass flow rates.

Figure 10:
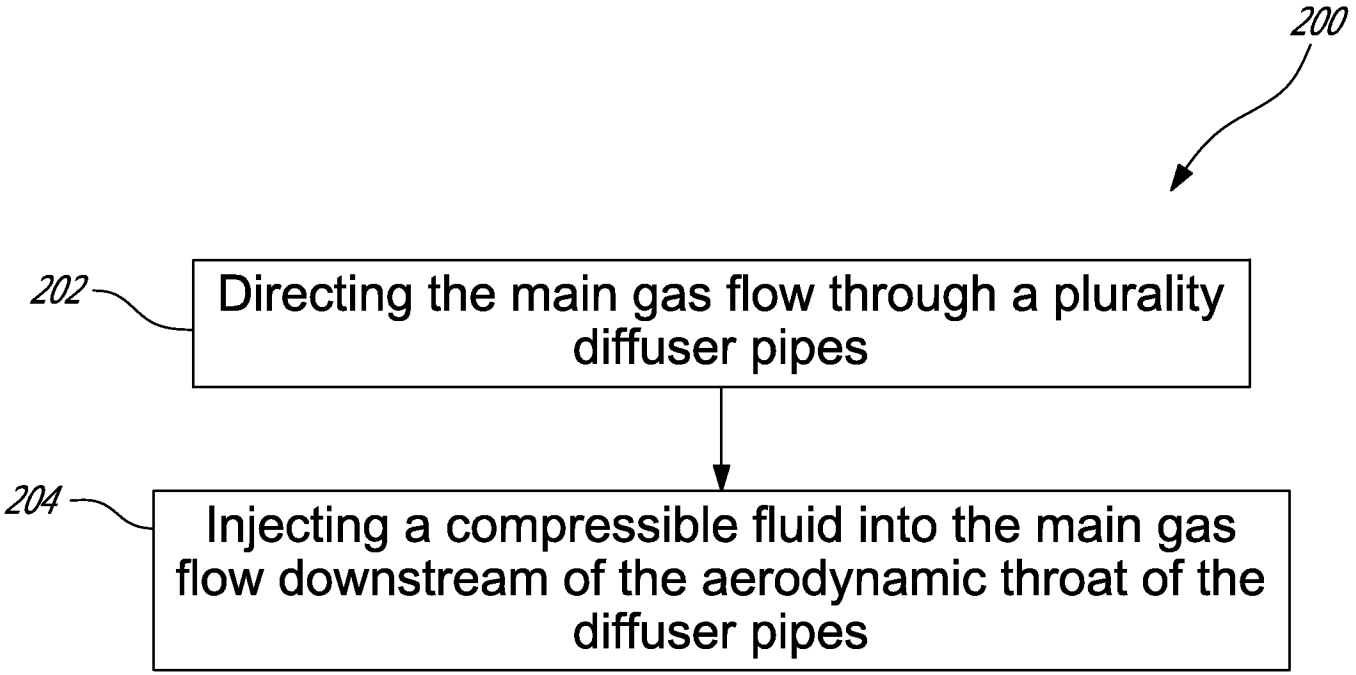
FIG. 10 is a flow diagram of a method for increasing the aerodynamic performance of a centrifugal compressor.

According to another aspect, and referring to FIG. 10, there is provided a method 200 for increasing the aerodynamic performance of a centrifugal compressor having an impeller and a diffuser located downstream of the impeller. The expression "aerodynamic performance" can refer to one, or a combination, of the performance characteristics of the compressor. These can include, but are not limited to, its overall pressure ratio, efficiency, stall margin, etc.

A main gas flow is drawn into the impeller substantially axially through its inlet. This can occur when the impeller of the centrifugal compressor begins to rotate. The main gas flow is then conveyed substantially radially away from the impeller and into the diffuser.

The method 200 involves directing the main gas flow through a plurality of diffuser pipes of the diffuser between an inlet and an outlet thereof, represented by the reference number 202. The main gas flow is diffused as it is drawn along the length of the diffuser pipes. As explained above, the main gas flow can be redirected, which may involve bending or curving it so that it flows in a direction being substantially parallel to the central axis of the engine.

The method 200 also involves injecting a compressible fluid into the main gas flow in one or more of the diffuser pipes at a location downstream of an aerodynamic throat of each of the diffuser pipes, represented by the reference number 204. As previously explained, the injection of the compressible fluid can energize the boundary layer of the main gas flow and prevent, or reduce the likelihood of, flow separation downstream. Where flow reversal occurs during redirection of the main gas flow, injecting the compressible fluid in 204 can involve injecting the compressible fluid upstream of redirecting the main gas flow.

Furthermore, injecting the compressible fluid in 204 can involve converging a flow of the compressible fluid prior to injecting it into each of the diffuser pipes, such as with the convergent duct described above. The direction of the injected compressible fluid can be substantially parallel to a flow of the main gas flow in each of the diffuser pipes. The direction of the injected compressible fluid can also be at a convergence angle θ with a plane tangent to an outer surface of each of the diffuser pipes.

Injecting the compressible fluid in 204 can also involve drawing the compressible fluid from a supply of P3 air downstream of the diffuser pipes, such as at the pipe outlet or from the combustor inlet. This drawing of the P3 compressible fluid can be accomplished by circulating or recirculating the P3 air passively from the supply as a result of a pressure differential to each of the diffuser pipes. Alternatively, the drawing of the P3 compressible fluid can be accomplished by actively pumping the compressible fluid from the supply to each of the diffuser pipes.

In light of the preceding, it can be appreciated that the diffuser 20 and method 200 disclosed herein can result in an improved stall range for the diffuser 20 when compared to some conventional diffusers. Furthermore, the diffuser 20 and method 200 disclosed herein can help to reduce flow blockage downstream of the pipe throat 48 by strengthening the boundary layer of the wall of the diffuser pipes 40. This lower flow blockage at the pipe outlet 44 can help to induce less back pressure at the pipe inlet 42, thus helping to improve the overall stability of the compressor 14*a*. In contrast, some prior art techniques for improving diffuser stall margin rely on injecting air upstream of the throat of the diffuser pipe, which can reduce the effective area of the diffuser pipe's throat and move the diffuser's operating point toward a different impeller/diffuser match position. Existing techniques can also require expensive hardware changes, such as modifying the leading edge incidence angle for the vanes of the diffuser.

The above description is meant to be exemplary only, and one skilled in the art will recognize that changes may be made to the embodiments described without departing from the scope of the invention disclosed. For example, and as previously mentioned, although the diffusion members are often referred to herein as diffusion pipes, it will be appreciated that the diffusion members can be other devices or mechanisms, such as vane diffusers, passage diffusers, vaneless diffusers, and pipe diffusers. Other modifications which fall within the scope of the present invention will be apparent to those skilled in the art, in light of a review of this disclosure, and such modifications are intended to fall within the appended claims.

The invention claimed is:

1. An assembly having a diffuser for diffusing gases radially received from a radial outlet of a centrifugal compressor including an impeller having an inner hub with vanes thereon, the impeller adapted to rotate within an outer shroud about a central longitudinal axis, the assembly comprising:

an annular diffuser body having a plurality of circumferentially spaced apart diffuser passages at least partially defining fluid paths through the diffuser body, the diffuser passages each having a passage inlet in fluid communication with the radial outlet of the compressor, and a passage outlet;

a plurality of diffusion members mounted to the annular diffuser body, each diffusion members having a member inlet in fluid communication with the passage outlet of a corresponding diffuser passage and a member outlet, each diffusion member defining an aerodynamic throat disposed between the member inlet and the member outlet; and a fluid injection assembly having a plurality of injection conduits, each injection conduit extending between a conduit inlet configured to receive a flow of compressible fluid from a supply and a conduit outlet communicating with a corresponding diffusion member downstream of the aerodynamic throat relative to a direction of a main gas flow through said diffusion member.

2. The assembly as defined in claim 1, wherein the diffusion members are diffuser pipes, each diffuser pipe having a first section beginning at the member inlet and extending away therefrom, a second section extending substantially parallel to the central axis along a second section length terminating at the member outlet of the diffuser pipe, and a curved section in fluid communication with the first and second sections and disposed downstream of the first section and upstream of the section sections, the throat of each diffuser pipe being disposed in at least one of the first and the curved sections.

3. The assembly as defined in claim 2, wherein the throat of each diffuser pipe is disposed in the first section, the conduit outlets of the injection conduits opening into corresponding diffuser pipes within the first section downstream of the throat.

4. The assembly as defined in claim 1, wherein at least one injection conduit has a convergent duct extending between the conduit inlet and the conduit outlet.

5. The assembly as defined in claim 4, wherein the convergent duct is oriented substantially parallel to a flow of the main gas flow in said diffusion member.

6. The assembly as defined in claim 1, wherein the conduit outlet of at least one injection conduit is an injection slot extending through a wall of said diffusion member.

7. The assembly as defined in claim 1, wherein the supply is disposed downstream of the member outlets of the diffusion members in a region of the compressor having P3 air, the P3 air having a static pressure greater than a static pressure at the conduit inlets of the injection conduits, the P3 air circulating passively from the supply to the conduit inlets of the injection conduits.

8. A method for controlling a centrifugal compressor, the centrifugal compressor including an impeller which feeds a main gas flow into a diffuser downstream therefrom, the method comprising:

directing the main gas flow through a plurality of diffusion members of the diffuser between an inlet and an outlet thereof; and injecting a compressible fluid into the main gas flow in the diffusion members at a location downstream of an aerodynamic throat of each of the diffusion members.

9. The method as defined in claim 8, wherein injecting the compressible fluid comprises injecting the compressible fluid upstream of redirecting the main gas flow in each diffusion member.

10. The method as defined in claim 8, wherein injecting the compressible fluid further comprises converging a flow of the compressible fluid prior to injecting it into each of the diffusion members.

11. The method as defined in claim 8, wherein injecting the compressible fluid further comprises injecting the compressible fluid into each of the diffusion members along a direction substantially parallel to a direction of the main gas flow within each of the diffusion members.

12. The method as defined in claim 8, wherein injecting the compressible fluid further comprises drawing the compressible fluid from a supply of P3 air downstream of the diffusion members.

13. The method as defined in claim 12, wherein drawing the compressible fluid comprises circulating P3 air passively from the supply to each of the diffusion members.

14. The method as defined in claim 12, wherein drawing the compressible fluid comprises pumping the compressible fluid from the supply to each of the diffusion members.

15. A centrifugal compressor, comprising:

an impeller having an inner hub with vanes thereon and adapted to rotate within an outer shroud about a central longitudinal axis, the impeller having a radial impeller outlet; and a diffuser assembly for diffusing gases radially received from the impeller outlet, comprising:

an annular diffuser body having a plurality of circumferentially spaced apart diffuser passages at least partially defining fluid paths through the diffuser body, the diffuser passages each having a passage inlet in fluid communication with the impeller outlet and a passage outlet;

a plurality of diffusion members mounted to the annular diffuser body, each diffusion member having a member inlet in fluid communication with the passage outlet of a corresponding diffuser passage and a member outlet, each diffusion member defining an aerodynamic throat disposed between the member inlet and the member outlet; and a fluid injection assembly having a plurality of injection conduits, each injection conduit extending between a conduit inlet configured to receive a flow of compressible fluid from a supply and a conduit outlet communicating with a corresponding diffusion member downstream of the aerodynamic throat relative to a direction of a main gas flow through said diffusion member.

16. The compressor as defined in claim 15, wherein the diffusion members are diffuser pipes, each diffuser pipe having a first section beginning at the member inlet and extending away therefrom, a second section extending substantially parallel to the central axis along a second section length terminating at the member outlet, and a curved section in fluid communication with the first and second sections and disposed downstream of the first section and upstream of the section sections, the aerodynamic throat of each diffusion member being disposed in at least one of the first and the curved sections.

17. The compressor as defined in claim 15, wherein at least one injection conduit has a convergent duct extending between the conduit inlet and the conduit outlet.

18. The compressor as defined in claim 17, wherein the convergent duct is oriented substantially parallel to a flow of the main gas flow in said diffusion member.

19. The compressor as defined in claim 15, wherein the conduit outlet of at least one injection conduit is an injection slot extending through a wall of said diffusion member.

20. The compressor as defined in claim 15, wherein the supply is disposed downstream of the pipe outlets of the diffusion members in a region of the compressor having P3 air, the P3 air having a static pressure greater than a static pressure at the conduit inlets of the injection conduits, the P3 air circulating passively from the supply to the conduit inlets of the injection conduits.

* * * * *